United States Patent [19]

Watanabe

[11] Patent Number: 4,473,268

[45] Date of Patent: Sep. 25, 1984

[54] DEVICE FOR MOUNTING CARTRIDGE FUSE

[75] Inventor: Tosizi Watanabe, Hitachi, Japan

[73] Assignee: Hitachi, Ltd., Tokyo, Japan

[21] Appl. No.: 342,792

[22] Filed: Jan. 26, 1982

[51] Int. Cl.[3] ..... H01R 4/30; H01R 11/22

[52] U.S. Cl. ..... 339/110 R; 337/215; 339/113 R; 339/147 R; 339/221 R; 339/258 F

[58] Field of Search ..... 339/113 R, 113 L, 147 R, 339/147 P, 258 F, 259 F, 262 F, 263 L, 113 B, 221 R, 221 M, 110 R; 337/214, 215, 234, 236, 237, 241

[56] References Cited

U.S. PATENT DOCUMENTS

| | | | |
|---|---|---|---|
| 2,411,014 | 11/1946 | Warnke | 339/113 B |
| 3,418,615 | 12/1968 | Canney | 337/215 |
| 3,457,535 | 7/1969 | Poehlman | 337/241 |
| 3,786,393 | 1/1974 | Conrad | 339/113 R |

FOREIGN PATENT DOCUMENTS

| | | | |
|---|---|---|---|
| 1490982 | 10/1969 | Fed. Rep. of Germany | 339/113 R |
| 2810897 | 10/1978 | Fed. Rep. of Germany | 337/236 |
| 125834 | 3/1952 | Japan . | |

*Primary Examiner*—John McQuade
*Assistant Examiner*—Paula Austin
*Attorney, Agent, or Firm*—Antonelli, Terry & Wands

[57] ABSTRACT

A device for mounting a cartridge fuse comprises an insulating base in the form of a hollow rectangular parallelepiped having an upper wall opened to define an opening, a pair of forked clips fixed in the base for clipping the conductive portions of the cartridge fuse, each of the clips being provided with a single hole bored in the yoke or bottom portion thereof, a pair of engaging grooves formed in the base, a pair of engaging pawls extending from each of the clips for resilient engagement with the associated one of the engaging grooves, and a screw passed through the single hole of each of the clips to anchor the clip to the base, and, at the same time, to connect the clip to an external electrical cable. The cartridge fuse is loosely held at its insulating portion in a cylindrical holding member forming part of a cover so that, by the closure of the opening of the base by the cover, the cartridge fuse can be clipped at its conductive portions by the clips.

7 Claims, 10 Drawing Figures

DEVICE FOR MOUNTING CARTRIDGE FUSE

BACKGROUND OF THE INVENTION

This invention relates to a device for mounting a cartridge fuse and, more particularly, to a fuse mounting device whose size can be made smaller than hitherto.

In a fuse mounting device commonly employed in the art, a pair of spaced forked clips are fixed on a base of an electrical insulating material such as a synthetic resin, and a cartridge fuse is clipped at its conductive cylindrical portions by the respective clips. The cartridge fuse is commonly carried by a cover so that the operator can be protected against an electrical shock and the fuse can be easily removed together with the cover.

The clips in such a fuse mounting device are fixed to the insulating base by set screws. On the other hand, it is necessary to electrically connect each of the clips to an end of an electrical cable.

In one form of the forked clip employed in a prior art fuse mounting device, the clip has an elongated bottom portion at its yoke portion connected between the opposite fork portions, and a pair of spaced holes are bored in the bottom portion. One of the two holes is utilized for anchoring the clip to the base, and the other hole is utilized for maintaining the clip in position and connecting the clip to an associated electrical cable. Such a prior art construction is disclosed in, for example, Japanese Utility-model Application Laid-open No. 53-125834 entitled "FUSE MOUNTING DEVICE", wherein the clip has an elongated bottom, and two holes are bored in a yoke portion.

However, the clips in the prior art fuse mounting device have inevitably a large dimension in the longitudinal direction of the base because of the necessity for boring the two spaced holes in the bottom portion of each of the clips. Therefore, the longitudinal dimension of the base must also be increased, with the result that the overall size of the fuse mounting device becomes inevitably large. Since a plurality of such fuse mounting devices are disposed in juxtaposition on a board such as a power board, a wide space is inevitably required for the disposition of them. Therefore, development of a small-sized fuse mounting device is now strongly demanded.

SUMMARY OF THE INVENTION

It is an object of the present invention to provide a novel and improved fuse mounting device whose size can be made small than hitherto.

Another object of the present invention is to provide a fuse mounting device in which a cartridge fuse can be simply held on a cover.

The present invention is featured by the fact that the yoke or bottom portion connecting the opposite contact strips of each of a pair of forked clips is provided with a single hole, and resilient engaging means outward and downward extends from the yoke or bottom portion of each of the clips to make resilient engagement with an engaging groove provided on a base, the hole bored in the yoke or bottom portion of each of the clips being utilized for anchoring the clips to the base and electrically connecting the clip to an associated electrical cable.

The present invention is further featured by the fact that a cylindrical holding member, fixed to a cover for holding the cartridge fuse, is so sized and shaped that its inner diameter is approximately equal to the outer diameter of the conductive cylindrical portions of the cartridge fuse, its axial length is slightly shorter than that of the insulating cylindrical portion of the cartridge fuse, and it has a longitudianlly extending slit in the area opposite to the cover.

DESCRIPTION OF THE PREFERRED EMBODIMENTS

Figure 1:
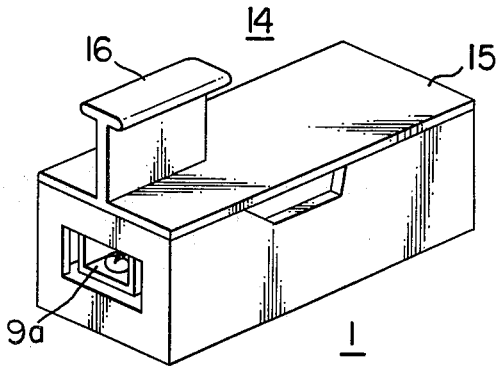
FIG. 1 is a perspective view showing a preferred embodiment of the fuse mounting device of the present invention in its assembled state.
Figure 2:
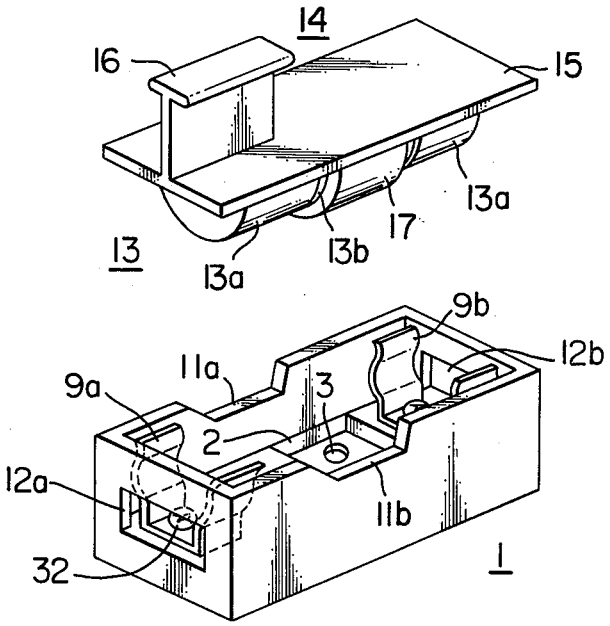
FIG. 2 is an exploded perspective view of the device of FIG. 1 in the state in which the cartridge fuse is removed from the clips together with the cover.
Figure 3:
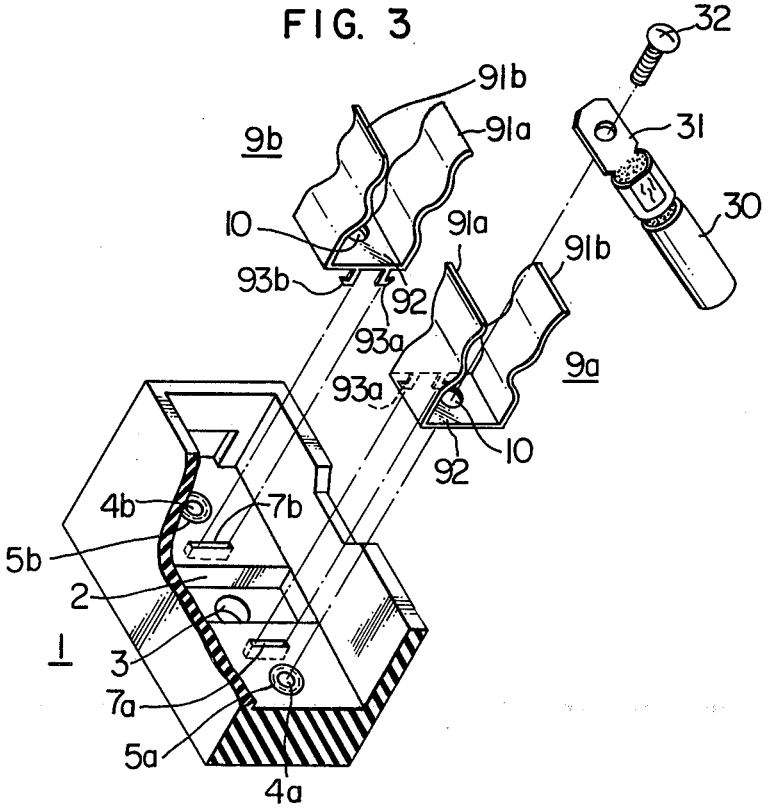
FIG. 3 is a partly cut-away, exploded view showing the device in the state in which the clips are detached from the insulating base.

Referring now to the drawings wherein like reference numerals are used throughout the various views to designate like parts and, more particularly, to FIGS. 1 to 3, according to these figures, a base 1 is provided by molding an electrical insulating material, such as a synthetic resin, into the form of a hollow rectangular parallelepiped having one of the longitudinal walls removed or opened to define an opening. A pair of spaced forked clips 9*a* and 9*b* made of an electrical conductive material, are anchored to the inner bottom surface of the insulating base 1 by set screws 32. A square recess 2 is formed in a substantially middle portion of the inner bottom surface of the base 1. A mounting hole 3 for mounting the base 1 on a board such as a power board, extends through the bottom wall at the center of the square recess 2. This square recess 2 is provided so that the head of a screw (not shown) mounting the base 1 on the power board may not make contact with a cartridge fuse described later. A pair of spaced circular depressions 4*a* and 4*b* are provided in the inner bottom surface of the base 1 at positions symmetrical in the longitudinal direction of the base 1, and a pair of screw-receiving nuts 5*a* and 5*b* are embedded in the circular depressions 4*a* and 4*b* respectively. These nuts 5*a* and 5*b* are molded together with the base 1. A pair of spaced rectangular engaging grooves 7*a* and 7*b* are also provided in the inner bottom surface of the base 1 at positions between the square recess 2 and the circular depressions 4*a*, 4*b* respectively. A pair of aligned square slots 12*a* and 12*b* are respectively provided in the transverse side walls of the base 1 to permit insertion therethrough of cables 30 to be electrically connected to the respective forked clips 9*a* and 9*b*. A pair of aligned trapezoidal cutouts 11*a* and 11*b* are provided at the upper edges of the longitudinal side walls of the base 1.

Each of the forked clips 9*a* and 9*b* made of an electrical conductive material includes a pair of opposite resilient contact strips 91*a* and 91*b*, of corrugated form, are bent in symmetrical relation and are connected to each other by a yoke or bottom portion 92. A pair of resilient engaging pawls 93*a* and 93*b* extend downward from the outer under surface of the yoke or bottom portion 92 of each of the clips 9*a* and 9*b*. These pairs of engaging pawls 93*a* and 93*b* make resilient engagement with the rectangular engaging grooves 7*a* and 7*b*, respectively, of the base 1 thereby anchoring the clips 9*a* and 9*b* to the base 1. A single hole 10 is bored in the yoke or bottom portion 92 connected between the opposite contact strips 91*a* and 91*b* of each of the clips 9*a* and 9*b*. The cable 30 is provided at its connecting end with a cable connection terminal 31, and a set screw 32 is passed through the terminal 31 and the hole 10 of the clip 9*a* or 9*b* to be screwed into the nut 5*a* or 5*b*. Thus, the clips 9*a* and 9*b* are fixed by the screws 32 to the base 1 as shown in FIG. 2.

Figure 4:
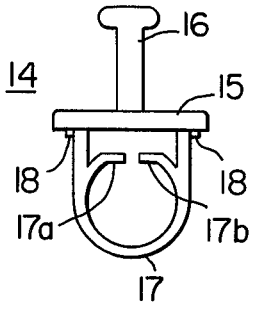
FIG. 4 is a front elevation view of the cover.
Figure 5:
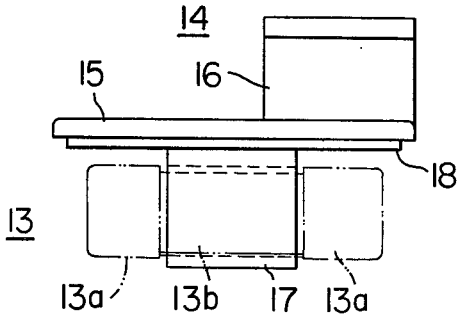
FIG. 5 is a side elevation view of the cover.
Figure 6:
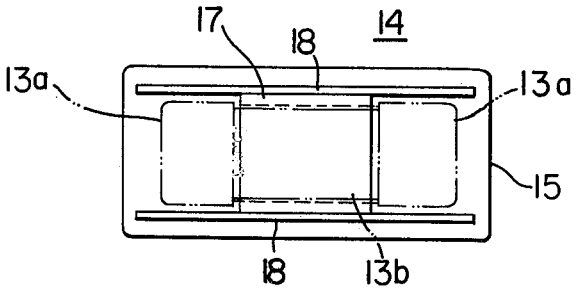
FIG. 6 is a bottom plan view of the cover.

Referring to FIGS. 4 to 6, there is shown a cover 14 for holding a cartridge fuse 13. The cover 14 is made of a transparent electrical insulating material and includes a rectangular flat plate 15, and a T-shaped grip 16 provided on one of the surfaces of the rectangular flat plate 15. This T-shaped grip 16 extends in the longitudinal direction from one of the longitudinal ends of the flat plate 15 at a position substantially centrally of the width and terminates in a position substantially middle of the length of the flat plate 15. A hollow cylindrical holding member 17 is fixed to the other surface of the flat plate 15. This cylindrical holding member 17 includes a generally U-shaped holder having a pair of opposite tongues 17*a* and 17*b* extending toward each other from the inner wall thereof to define a generally hollow cylinder together with the U-shaped portion. The inner diameter of the cylindrical portion of the cylindrical holding member 17 is approximately equal to the outer diameter of the conductive cylindrical portions 13*a* of the cartridge fuse 13, and the length of the cylindrical holding member 17 is slightly shorter than that of the insulating cylindrical portion 13*b* of the cartridge fuse 13. Thus, in other words, this cylindrical holding member 17 provides a cylindrical holder which has a slit extending in the longitudinal direction in the area opposite to the flat plate 15. The cover 14 is provided with a pair of spaced linear projections 18 for guiding the cover 14 when the cover 14 is fitted on the base 1.

Figure 7:
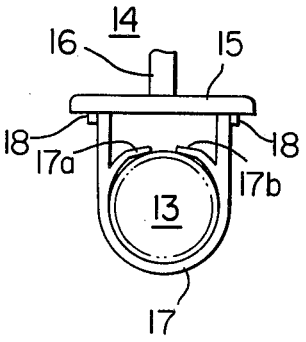
FIGS. 7 and 8 illustrate how the cartridge fuse is held by the cylindrical holding member.
Figure 8:
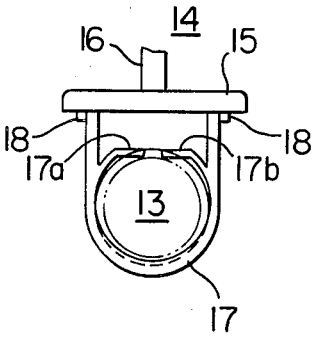

In mounting the cartridge fuse 13 on the cover 14, one of the conductive cylindrical portions 13*a* of the cartridge fuse 13 is first inserted into the cylindrical holding member 17. This causes the resilient tongues 17*a* and 17*b* of the cylindrical holding member 17 to slightly open, as best shown in FIG. 7. When the cartridge fuse 13 is further inserted until its insulating cylindrical portion 13*b* is inserted into the cylindrical holding member 17, the tongues 17*a* and 17*b* return to their original positions by the resiliency, as best shown in FIG. 8. The outer diameter of the conductive cylindrical portions 13*a* of the cartridge fuse 13 is larger than that of the insulating cylindrical portion 13*b*. Therefore, the cartridge fuse 13 is loosely held in the cylindrical holding member 17.

After mounting the cartridge fuse 13 on the cover 14 in the manner described above, the cover 14 having the cartridge fuse 13 mounted as shown in FIG. 2 is fitted on the base 1. The opening of the base 1 is covered with the cover 14, and, at the same time, the conductive cylindrical portions 13*a* of the cartridge fuse 13 are clipped by the respective clips 9*a* and 9*b*, thereby completing assembly of the cartridge fuse 13 in the casing composed of the base 1 and the cover 14, as shown in FIG. 1.

In the fuse mounting device of the present invention, the resilient engaging pawls 93*a* and 93*b* are formed at one end of the outer lower surface of each of the yoke or bottom portions 92 of the clips 9*a* and 9*b*, and these engaging pawls 93*a* and 93*b* are forcibly inserted into the associated rectangular grooves 7*a* and 7*b* respectively provided in the base 1 to mount the clips 9*a* and 9*b* on the base 1. A single hole 10 is bored in the yoke or bottom portion 92 of each of the clips 9*a* and 9*b*, and the set screw 32 is passed through the cable connection terminal 31 of the cable 30 and through the hole 10 of the yoke or bottom portion 92 of one of the clips 9*a* and 9*b* to be screwed into the associated one of the nuts 5*a* and 5*b* thereby fixing the terminal 31 on the base 1. It will therefore, be seen that a single hole 10 is merely provided in the yoke or bottom portion 92 connected between the opposite contact strips 91*a* and 91*b* of each of the clips 9*a* and 9*b*, so that the dimension of the clips 9*a* and 9*b* in the longitudinal direction of the base 1 can be reduced. Because of the reduced dimension of the clips 9*a* and 9*b* in the longitudinal direction of the base 1, the dimension of the base 1 in its longitudinal direction can also be reduced to reduce the overall size of the fuse mounting device.

According to the present invention, it is merely necessary to insert the cartridge fuse 13 into the cylindrical holding member 17 forming part of the cover 14, and the direction of insertion of the cartridge fuse 13 into the cylindrical holding member 17 for holding the cartridge fuse 13 in the cylindrical holding member 17 differs from the direction of withdrawal of the cartridge fuse 13 from the clips 9*a* and 9*b*. Therefore, the cartridge fuse 13 need not be firmly held by the cylindrical holding member 17, and the cartridge fuse 13 can be simply mounted on the cover 14.

In the aforementioned embodiment of the present invention, the resiliency of the resilient engaging pawls 93*a* and 93*b* of the clips 9*a* and 9*b* is utilized to lock the clips 9*a* and 9*b* to the base 1. Therefore, accidental disengagement of the clips 9*a* and 9*b* from the base 1 can be reliably prevented even when an external force may be imparted to the base 1 during connection of the terminals 31 of the cables 30 to the clips 9*a* and 9*b*, and the terminals 31 can be easily connected with screws 32 to the base 1 through the holes 10 of the clips 9*a* and 9*b*.

In the present invention, the cover 14 is transparent in its entirety, and the cartridge fuse 13 is loosely held in the cylindrical holding member 17. Therefore, the fuse specification such as the fuse rating described on the insulating cylindrical portion 13*b* of the cartridge fuse 13 can be easily inspected from the exterior even after the fuse 13 has been mounted in position.

Figure 9:
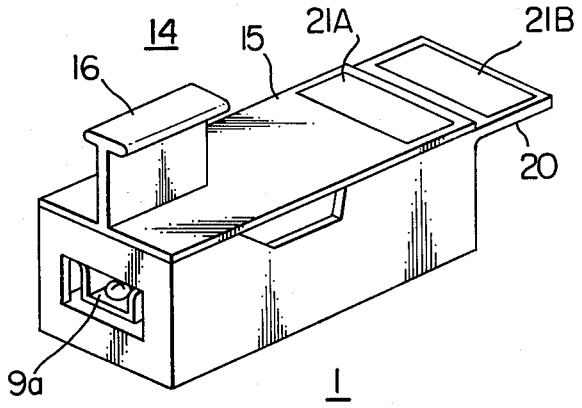
FIG. 9 is a perspective view showing another embodiment of the present invention in its assembled state.
Figure 10:
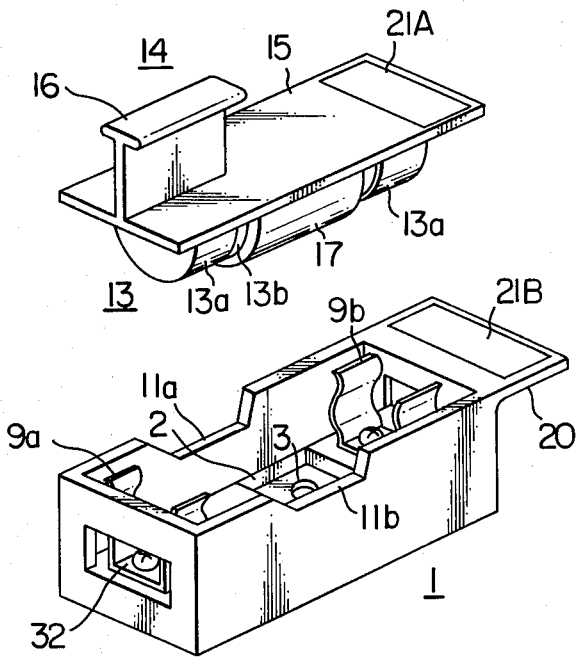
FIG. 10 is an exploded perspective of the device of FIG. 9 in the state in which the cartridge fuse is removed from the clips, together with the cover.

Referring to FIGS. 9 and 10, an extension 20 extends in the longitudinal direction of the base 1 from one of the transverse side walls of the base 1, and a rating plate 21B is attached to this extension 20. The provision of the extension 20 of the base 1 and attachment of the rating plate 21B on the extension 20 is advantageous in that the rating printed on the rating plate 21B can be readily compared with that printed on a rating plate 21A attached to the cover 14. Therefore, the rating of the cartridge fuse 13 can be easily immediately identified by collation with that of the base 1, so that mounting of a wrong one can be prevented. Further, the rating plates identifying the ratings of the individual fuses need not be attached to the front panel of the power board, and this eliminates the necessity for careful connection to various power sources. Therefore, the modification is advantageous in that the design can be standardized, and the mounting density can be increased.

It will be appreciated from the foregoing description that the present invention can provide a small-sized fuse mounting device. It will also be appreciated that a cartridge fuse can be very simply clamped to a cover by merely inserting it into a cylindrical holding member.

I claim:

1. A device for mounting a cartridge fuse comprising:

an insulating base molded in a form of a hollow rectangular parallelpiped with one longitudinal side thereof being open;

a pair of forked clips disposed on an inner bottom surface of said insulating base in a relation opposite to each other in a longitudinal direction of said insulating base, each of said clips including a pair of contact strips for clipping therebetween respective conductive cylindrical portions of the cartridge fuse, a yoke or bottom portion connected between said opposite contact strips, and a single hole bored in said yoke or bottom portion;

a pair of spaced engaging grooves formed in said inner bottom surface of said insulating base, said spaced engaging grooves being disposed opposite from each other in the longitudinal direction of said insulating base;

engaging means including a protrusion provided on a lower surface of one of said yoke or bottom portion of each of said clips for making resilient engagement with corresponding ones of said engaging grooves; and anchoring means for anchoring each of said clips to said insulating base utilizing said single hole, said anchoring means functioning for electrically connecting said clip to an external electrical cable in addition to the function of anchoring said clip to said insulating base.

2. A cartridge fuse mounting device as claimed in claim 1, wherein said anchoring means for anchoring said clip to said insulating base includes screw means.

3. A cartridge fuse mounting device comprising:

an insulating base molded in a form of a hollow rectangular parallelpiped with one longitudinal side thereof being open;

a pair of forked clips disposed on an inner bottom surface of said insulating base in a relation opposite to each other in a longitudinal direction of said insulating base, each of said clips including a pair of contact strips for clipping therebetween respective conductive cylindrical portions of the cartridge fuse, a yoke or bottom portion connected between said opposite contact strips, and a single hole bored in said yoke or bottom portion;

a pair of spaced engaging grooves formed in said insulating base;

engaging means provided on each of said clips for making resilient engagement with corresponding ones of said engaging grooves, said engaging means includes a pair of pawls extending downwardly from an outer lower surface of said yoke or bottom portion of said clip; and anchoring means for anchoring each of said clips to said insulating base utilizing said single hole, said anchoring means functioning for electrically connecting said clip to an external electrical cable in addition to the function of anchoring said clips to said insulating base.

4. A device for mounting a cartidge fuse comprising:

an insulating base molded in a form of a hollow rectangular parallelpiped with one longitudinal side thereof being open to define an opening;

a pair of forked clips disposed on an inner bottom surface of said insulating base in a relation opposite to each other in a longitudinal direction of said insulating base, each of said clips including a pair of contact strips for clipping therebetween conductive cylindrical portions of the cartridge fuse, a yoke or bottom portion connected between said opposite contact strips, and a single hole bored in said yoke or bottom portion;

a pair of spaced engaging grooves formed in said inner bottom surface of said insulating base in a relation opposite to each other in the longitudinal direction of said insulating base;

engaging means including a protrusion provided on a lower surface of said yoke or bottom portion of each of said clips for making resilient engagement with corresponding ones of said engaging grooves;

anchoring means for anchoring each of said clips to said insulating base utilizing said single hole, said anchoring means functioning for electrically connecting said clip to an external electrical cable in addition to the function of anchoring said clip to said insulating base;

a flat cover for mounting the cartridge fuse on one of its surfaces and for covering said opening of said insulating base to enclose the cartridge fuse within said base to thereby cause conductive cylindrical portions of the cartridge fuse to be clipped by said respective clips; and a hollow cylindrical holding member provided on said one surface of said flat cover and having an inner diameter substantially equal to an outer diameter of said conductive cylindrical portion of the cartridge fuse, a length slightly shorter than that of an insulating cylindrical portion of the cartridge fuse and a slit extending in its longitudinal direction, for loosely holding the insulating cylindrical portion of the cartridge fuse.

5. A cartridge fuse mounting device as claimed in claim 4, wherein said flat cover and said cylindrical holding member are made of a transparent electrical insulating material.

6. A cartridge fuse mounting device as claimed in claim 4, wherein said flat cover is provided with a grip on the other surface thereof.

7. A cartridge fuse mounting device as claimed in claim 4, wherein an extension used for the attachment of a rating plate extends in the longitudinal direction of said insulating base from one of transverse side walls of said insulating base.

* * * * *